US008622695B2

(12) United States Patent
Decker et al.

(10) Patent No.: US 8,622,695 B2
(45) Date of Patent: Jan. 7, 2014

(54) FLOW TRIM FOR VANE-AXIAL FANS

(75) Inventors: John J. Decker, Cypress, TX (US); Chellappa Balan, Niskayuna, NY (US); Patrick B. Lawless, Pismo Beach, CA (US)

(73) Assignee: Xcelaero Corporation, San Luis Obispo, CA (US)

( * ) Notice: Subject to any disclaimer, the term of this patent is extended or adjusted under 35 U.S.C. 154(b) by 1153 days.

(21) Appl. No.: 12/583,024

(22) Filed: Aug. 12, 2009

(65) Prior Publication Data

US 2011/0038724 A1 Feb. 17, 2011

(51) Int. Cl.
*F01D 25/24* (2006.01)

(52) U.S. Cl.
USPC ..... 415/214.1; 415/220

(58) Field of Classification Search
USPC ..... 415/173.1, 214.1, 218.1, 219.1, 220, 415/221, 912; 417/423.1, 423.14
See application file for complete search history.

(56) References Cited

U.S. PATENT DOCUMENTS 4,221,546 A * 9/1980 Papst et al. ..... 417/354
4,780,052 A * 10/1988 Pradelle ..... 415/119
6,953,320 B1 * 10/2005 Davis et al. ..... 415/147
2006/0073008 A1 * 4/2006 Penlesky et al. ..... 415/1
2006/0237168 A1 * 10/2006 Belady et al. ..... 165/104.33
2007/0020098 A1 * 1/2007 Foster et al. ..... 415/220

* cited by examiner

*Primary Examiner* — Edward Look
*Assistant Examiner* — Jason Davis
(74) *Attorney, Agent, or Firm* — Henry C. Query, Jr.

(57) ABSTRACT

A fan comprises a fan housing which includes a fan inlet, a motor which is connected to the fan housing, and an impeller which is removably connected to the motor. The impeller includes an impeller hub, a number of impeller blades which extend radially outwardly from the impeller hub, an impeller leading edge, an impeller trailing edge and an impeller tip. The fan housing includes an inlet shroud which is positioned over the impeller. The inlet shroud comprises an upstream end portion within which the fan inlet is formed and a downstream end portion which is removably connected to a separate portion of the fan housing. The inlet shroud further includes a first section which extends axially from the upstream end portion to approximately the impeller leading edge, a second section which extends axially from the first section to approximately the impeller trailing edge, and a third section which extends axially from the second section to approximately the downstream end portion. The second section comprises a configuration which conforms to the configuration of the impeller tip, and the third section comprises a radius which increases from approximately the upstream end of the third section to approximately the downstream end of the third section.

11 Claims, 4 Drawing Sheets

FLOW TRIM FOR VANE-AXIAL FANS

BACKGROUND OF THE INVENTION

The present invention relates generally to vane-axial fans. In particular, the invention relates to a vane-axial fan whose flow characteristics may be changed by modifying its impeller and inlet shroud so that the operation of the fan will remain stable for reduced flow requirements.

Typical vane-axial cooling fans include a motor-driven impeller which propels a stream of air through a fan housing. Such fans may include an outlet guide vane assembly which is positioned downstream of the impeller and acts to both de-swirl and increase the static pressure of the air. These fans may further include a diffuser section which is located downstream of the outlet guide vane assembly and functions to decelerate and thereby further increase the static pressure of the air.

Generally, a cooling fan is designed to meet a specific flow and pressure rise requirement, which is called the design point, for a specific rotational speed, which is referred to as the design speed. At a particular design speed, the flow and pressure rise are related by the fan's characteristic curve, an example of which is shown in FIG. 2. The characteristic curve reveals that when a low pressure rise is required, the fan will deliver a high flow, but as the required pressure rise increases, the flow delivered will decrease. However, as the required pressure rise reaches a certain point, the fan will exhibit flow instability, which is commonly called stall. In many applications this instability may be potentially hazardous, and operation at the required design point is therefore not allowed. Instead, a different fan design will have to be used which is capable of producing the required pressure rise at a lower flow.

SUMMARY OF THE INVENTION

In accordance with the present invention, a fan is provided which is capable of producing a required pressure rise while maintaining stable operation. The fan comprises a fan housing which includes a fan inlet; a motor which is connected to the fan housing; and an impeller which is removably connected to the motor. The impeller comprises an impeller hub, a number of impeller blades which extend radially outwardly from the impeller hub, an impeller leading edge, an impeller trailing edge and an impeller tip. The fan housing includes an inlet shroud which is positioned over the impeller. The inlet shroud includes an upstream end portion within which the fan inlet is formed and a downstream end portion which is removably connected to a separate portion of the fan housing. The inlet shroud further includes a first section which extends axially from the upstream end portion to approximately the impeller leading edge, a second section which extends axially from the first section to approximately the impeller trailing edge, and a third section which extends axially from the second section to approximately the downstream end portion. Also, the second section comprises a configuration which conforms to the configuration of the impeller tip, and the third section comprises a radius which increases from approximately the upstream end of the third section to approximately the downstream end of the third section.

In accordance with one embodiment of the invention, the second section comprises a radius which is generally constant from approximately the upstream end of the second section to approximately the downstream end of the second section.

In accordance with another embodiment of the invention, the second section comprises a radius which increases from approximately the upstream end of the second section to approximately the downstream end of the second section. For example, the radius of the second section may increase linearly from approximately the upstream end of the second section to approximately the downstream end of the second section. In another example, the radius of the second section may increase non-linearly from approximately the upstream end of the second section to approximately the downstream end of the second section.

In accordance with yet another embodiment of the invention, the downstream end portion of the inlet shroud is removably connected to an outlet guide vane assembly which is connected to the motor. Also, the third section defines an intermediate diffuser section between the impeller and the outlet guide vane assembly. Furthermore, the intermediate diffuser section may comprise an area ratio of about 1.2 or greater.

In accordance with a further embodiment of the invention, a fan is provided which comprises a fan housing which includes a fan inlet; a motor which is connected to the fan housing; and an impeller which is removably connected to motor. The impeller comprises an impeller hub, a number of impeller blades which extend radially outwardly from the impeller hub, an impeller leading edge, an impeller trailing edge and an impeller tip. The fan housing includes an inlet shroud which is positioned over the impeller. The inlet shroud includes an upstream end portion within which the fan inlet is formed and a downstream end portion which is removably connected to a separate portion of the fan housing. The inlet shroud further includes a first section which extends axially from the fan inlet to approximately the impeller leading edge, a second section which extends axially from the first section to approximately the impeller trailing edge, and a third section which extends axially from the second section to approximately the downstream end portion. Also, the impeller blades comprise a diameter which increases from the impeller leading edge to the impeller trailing edge, and the second section comprises a configuration which conforms to the configuration of the impeller tip.

In accordance with another embodiment of the invention the diameter of the impeller blades increases linearly from the impeller leading edge to the impeller trailing edge.

In accordance with yet another embodiment of the invention, the diameter of the impeller blades increases non-linearly from the impeller leading edge to the impeller trailing edge.

In accordance with a further embodiment of the invention, the third section comprises a radius which increases from approximately the upstream end of the third section to approximately the downstream end of the third section. Also, the third section defines an intermediate diffuser section immediately downstream of the impeller blades. Furthermore, the intermediate diffuser section may comprise an area ratio of about 1.2 or greater.

The present invention is also directed to a method for altering the performance of a fan having a fan housing, a motor which is connected to the fan housing and a first impeller which is connected to the motor, the first impeller comprising a plurality of first impeller blades which define a first impeller tip and the fan housing comprising a removable first inlet shroud which is positioned over the first impeller. The method comprises the steps of providing a second impeller which comprises a plurality of second impeller blades that define a second impeller tip; providing a second inlet shroud which comprises a configuration that conforms to the configuration of the second impeller tip; removing the first impeller from the motor and the first inlet shroud from the fan housing; and connecting the second impeller to the motor and the second inlet shroud to the fan housing.

In accordance with one embodiment of the invention, the average diameter of the second impeller blades is smaller than the average diameter of the first impeller blades. In addition, the second impeller tip may comprise a generally cylindrical configuration, a generally conical configuration, or a curved configuration, among other configurations.

Thus, the cooling fan of the present invention comprises a matched impeller and inlet shroud which allow the fan to achieve a higher pressure rise at a lower flow. This enables the cooling fan to meet a higher pressure rise requirement while maintaining stable flow. In addition, the impeller tip may be designed with various configurations to meet a variety of pressure rise requirements while maintaining stable flow.

Also, the method of the present invention allows the impeller and inlet shroud to be modified as a matched pair, with the magnitude of the modification depending on the amount of flow reduction required. In accordance with this method, the remainder of the fan is unchanged. Thus, a particular fan may be tuned for various system impedances by substituting only two parts, namely, the impeller and the inlet shroud. Consequently, a single fan design can be optimized to suit many different applications, saving the additional design and manufacturing costs which are normally associated with multiple designs.

These and other objects and advantages of the present invention will be made apparent from the following detailed description with reference to the accompanying drawings. In the drawings, the same reference numbers are used to denote similar components in the various embodiments.

DETAILED DESCRIPTION OF THE INVENTION

The present invention is applicable to a variety of air movers. For purposes of brevity, however, it will be described in the context of an exemplary vane-axial cooling fan. Nevertheless, a person of ordinary skill in the art will readily appreciate how the teachings of the present invention can be applied to other types of air movers. Therefore, the following description should not be construed to limit the scope of the present invention in any manner.

Figure 1:
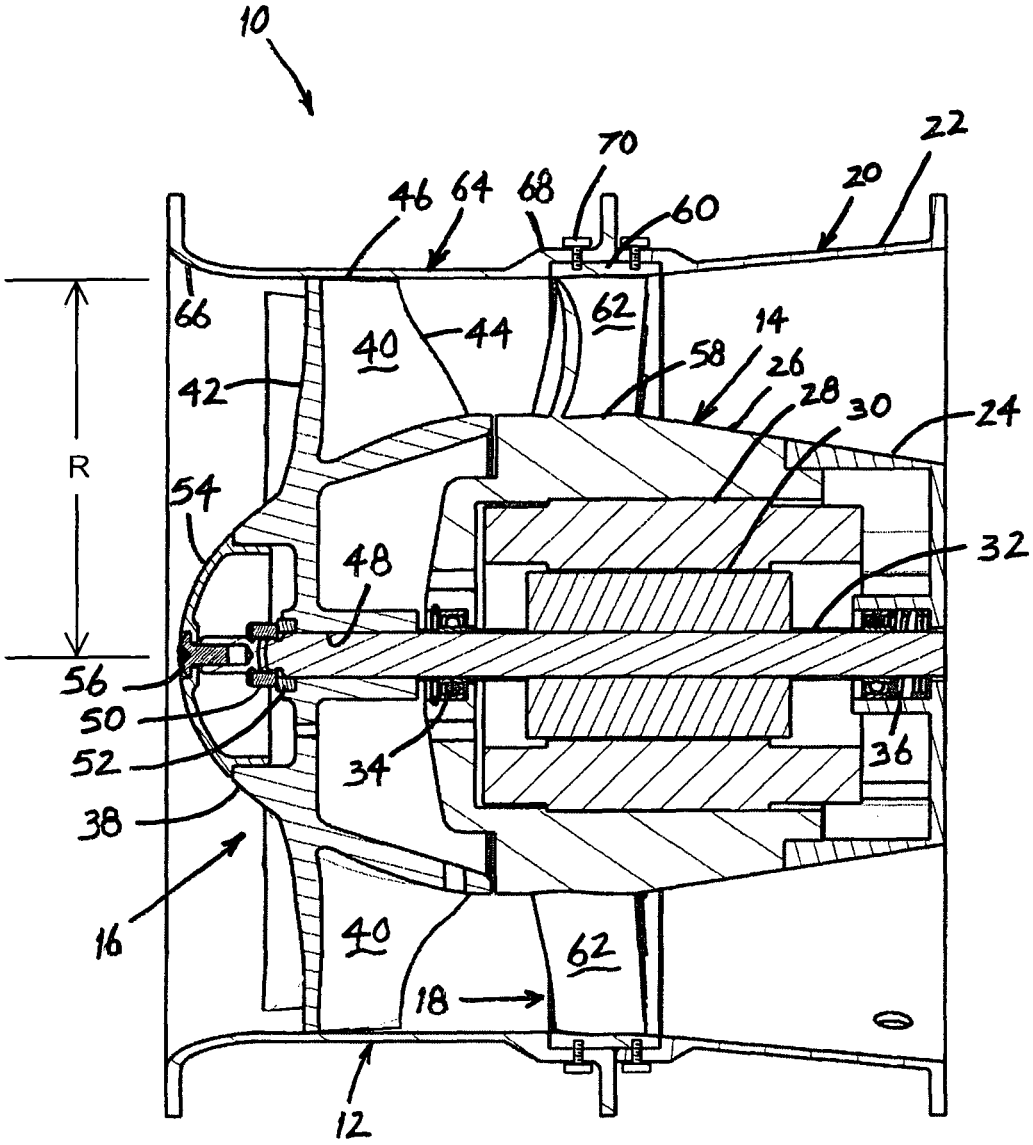
Fig. 1 (Prior Art)
FIG. 1 is a cross-sectional view of a prior art vane axial cooling fan.

Referring to FIG. 1, a representative prior art cooling fan, generally 10, is shown to comprise a tubular fan housing 12, a motor 14 which is supported within the fan housing 12, an impeller 16 which is driven by the motor 14, and an outlet guide vane assembly 18 which extends radially between the motor 14 and the fan housing 12. The cooling fan 10 may also include a diffuser section 20 which is located downstream of the outlet guide vane assembly 18 and which includes a diffuser tube 22 that is connected to or formed integrally with the fan housing 12 and a tail cone 24 that is connected to or formed integrally with the downstream end of the motor 14.

The motor 14 includes a motor housing 26, a stator 28 which is mounted within the motor housing, a rotor 30 which is positioned within the stator and a rotor shaft 32 which is connected to the rotor. The rotor shaft 32 is rotatably supported in a front bearing 34 which is mounted in the motor housing 26 and a rear bearing 36 which may be mounted in, e.g., the tail cone 24.

The impeller 16 comprises an impeller hub 38 and a number of impeller blades 40 which extend radially outwardly from the impeller hub. Each blade 40 comprises a leading edge 42, a trailing edge 44 and a tip 46. The leading edges 42 of all the blades 40 taken together may be considered the leading edge of the impeller 16. Likewise, the trailing edges 44 of all the blades 40 taken together may be considered the trailing edge of the impeller 16. Similarly, the tips 46 of all the blades 40 taken together may be considered the tip of the impeller 16, or the impeller tip. Each blade 40 may be considered to comprise a diameter which is defined as twice the radial distance between the centerline C of the impeller and the tip 46. This diameter may be constant from the leading edge 42 to the trailing edge 44, as in the impeller 16, or it may vary from the leading edge to the trailing edge. Moreover, the impeller tip, or more generally the impeller, may be considered to comprise a configuration which is defined by the variation in the diameter of the blades 40 from the leading edge 42 to the trailing edge 44. Thus, where as in the impeller 16 the diameter of the blades 40 is constant from the leading edge 42 to the trailing edge 44, the impeller tip is considered to be cylindrical.

The impeller hub 38 includes an axial bore 48 through which the rotor shaft 32 extends, and the shaft is secured to the impeller hub by, e.g., a pair of counteracting nuts 50, 52. The impeller hub 38 may also include a nose cone 54, which in this case is connected to the rotor shaft 32 by a screw 56.

The outlet guide vane assembly 18 includes an inner ring 58 which is attached to or formed integrally with the motor housing 26, an outer ring 60 which is connected to or formed integrally with the fan housing 12 and a plurality of guide vanes 62 which extend radially between the inner and outer rings. For purposes of the following description, the outer ring 60 may be considered part of the fan housing 12. In addition to its normal function of straightening the air stream produced by the impeller 16, the outlet guide vane assembly serves to connect the motor 14 to the fan housing 12.

The fan housing 12 comprises an inlet shroud 64 which is positioned over the impeller 16. The inlet shroud 64 includes an upstream end portion 66 within which the fan inlet is formed and a downstream end portion 68 which is removably connected to a separate portion of the fan housing 12. For example, the downstream end portion 68 may be connected to the outer ring 60 of the outlet guide vane assembly 18 by, e.g., a number of screws 70. The inlet shroud 64, or more precisely the inner surface of the inlet shroud, comprises a generally constant radius R between its upstream and downstream end portions 66, 68.

In operation, the motor 14 is energized to spin the impeller 16 and thereby draw air into and through the fan housing 12. The impeller 16 forces the air through the outlet guide vane assembly 18, which redirects the air stream into a substantially axial direction. The diffuser section 20 receives the air stream from the outlet guide vane assembly 18 and decelerates it in order to increase the static pressure of the air exiting the fan housing 12.

Figure 2:
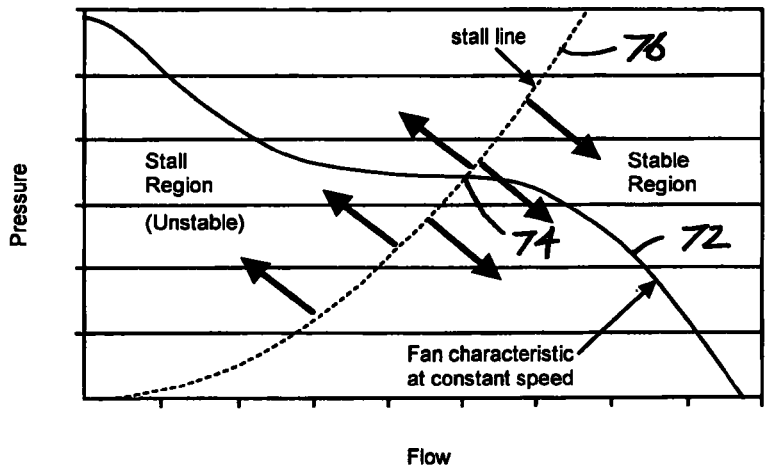
FIG. 2 is a graph depicting the flow characteristics of the fan of FIG. 1.

FIG. 2 is a graph depicting the flow characteristics of the cooling fan 10. In this graph, curve 72 represents the characteristic curve of the fan 10 at a specific operating speed. As shown by the curve 72, the performance of the fan 10 is dependent on the pressure rise across the fan. When a low pressure rise is required, the fan will deliver a high flow. As the required pressure rise increases, the flow delivered decreases until the fan begins to stall, which will occur at about the point 74. A stall line 76 may be plotted using a similar analysis of the characteristic curves for different operating speeds. The stall line 76 generally delineates between stable and unstable, or stall, regions of operation of the fan.

Normally, if a particular application requires that an existing fan operate at a design point which falls within the unstable region for the required design speed, a different fan design will have to be used. In accordance with the present invention, however, the characteristic curve of an existing fan can be altered by changing or modifying the impeller and the inlet shroud as a matched pair so that the required pressure rise can be achieved at a lower, stable flow.

Figure 3:
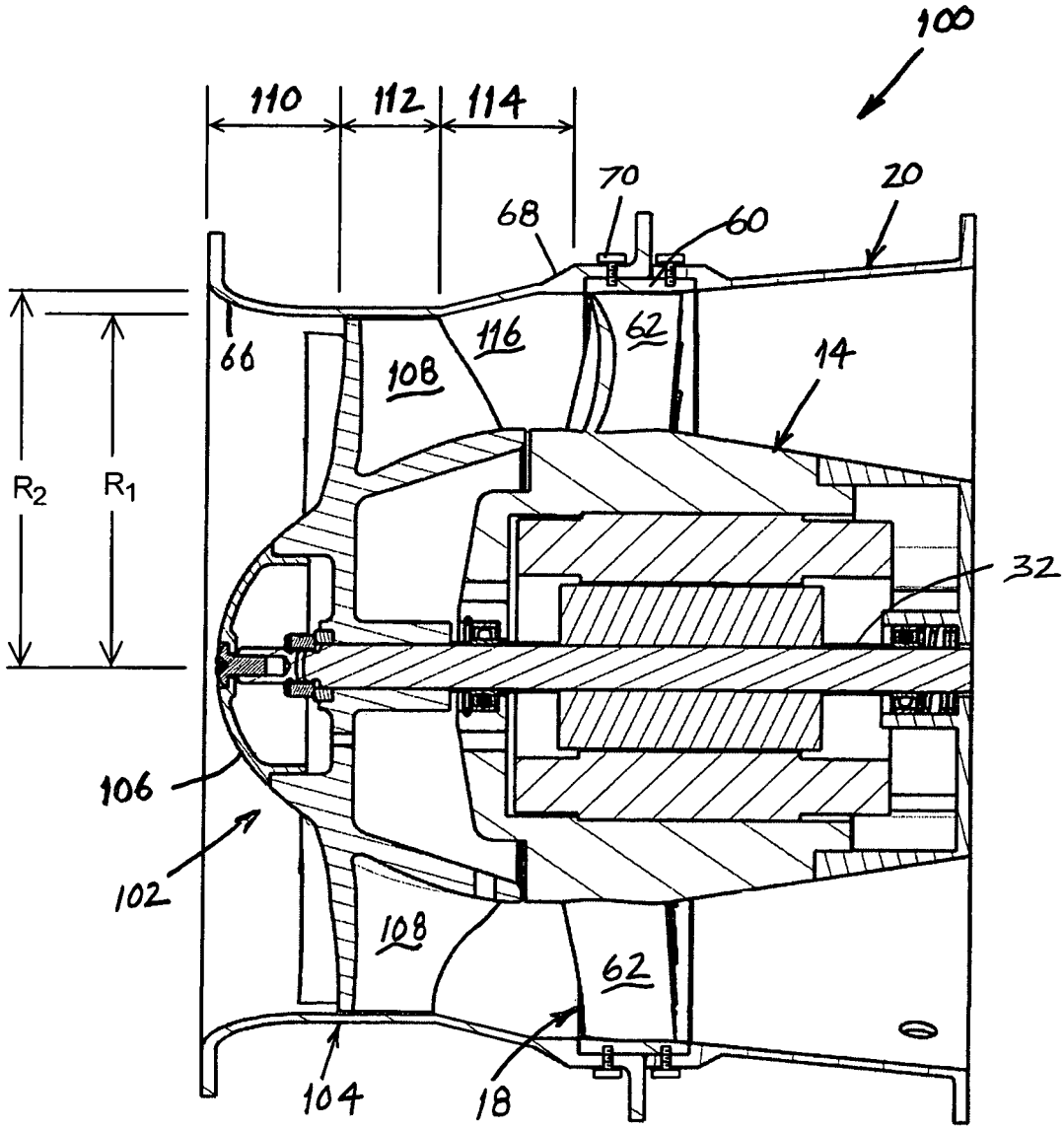
FIG. 3 is a cross-sectional view of an exemplary vane axial cooling fan in accordance with one embodiment of the present invention.

One embodiment of a cooling fan which has been constructed in accordance with the principles of the present invention is shown in FIG. 3. The cooling fan of this embodiment, generally 100, is similar to the cooling fan 10 described above. However, in this embodiment the impeller 16 and inlet shroud 64 of the cooling fan 10 have been removed and replaced with a different impeller 102 and inlet shroud 104. The impeller 102 and inlet shroud 104 are designed to provide the cooling fan 100 with operating characteristics which were not attainable with the cooling fan 10.

The impeller 102, which is similar in many respects to the impeller 16, comprises an impeller hub 106 and a number of impeller blades 108 which extend radially outwardly from the hub. The impeller hub 106 may be identical to the impeller hub 38 of the impeller 16, and it may be connected to the rotor shaft 32 in a similar fashion. As with the blades 40, the blades 108 comprise a generally constant diameter from their leading edge to their trailing edge. However, compared to the blades 40, the blades 108 have been trimmed, i.e., the diameter of the blades 108 is smaller than the diameter of the blades 40. Since the tip of the impeller 102 is generally cylindrical, the impeller tip may be considered to have been trimmed cylindrically. By "trimmed" we simply mean that the blades 108 are shorter than the blades 40. This may be achieved by removing the impeller 16 and reducing the diameter of the blades 40 by a suitable machining process. Alternatively, the impeller 16 may be replaced with a new impeller 102 whose blades 108 are designed with the desired diameter and configuration.

As shown in FIG. 3, the inlet shroud 104 is designed to conform to the impeller 102. Thus, the inlet shroud 104 of this embodiment is designed to have a number of axial sections: a first section 110 which extends from approximately the upstream end portion 66 of the inlet shroud to approximately the leading edge of the impeller 102, a second section 112 which extends from the first section to approximately the trailing edge of the impeller, and a third section 114 which extends from the second section to approximately the downstream end portion 62 of the inlet shroud. The first and second sections 110, 112 comprise a generally constant radius $R_1$, while the radius of the third section 114 increases, preferably linearly in this embodiment, from the radius $R_1$ at the upstream end of the third section to a radius $R_2$ at the downstream end of the section. Thus, the second section 112 comprises a generally cylindrical configuration which conforms to the cylindrical tip of the impeller 102.

The third section 114 defines an intermediate diffuser section 116 between the impeller blades 108 and the guide vanes 62 within which the air stream is allowed to expand. In contrast to intermediate diffuser sections of prior art cooling fans, the diffuser section 116 comprises a much larger area ratio, which is defined as the ratio of the area of the downstream end of the diffuser section, in this case $\pi(R_2^2-r_2^2)$, to the area of the upstream end of the diffuser section, in this case $\pi(R_1^2-r_1^2)$, where $r_1$ is the inner radius of the upstream end of the diffuser section and $r_2$ is the inner radius of the downstream end of the diffuser section. In the present invention, the area ratio of the diffuser section 116 is about 1.2 or greater.

Figure 4:
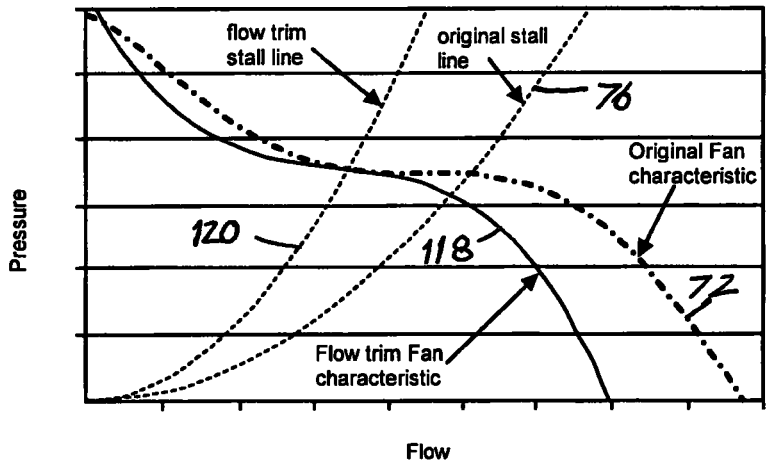
FIG. 4 is a graph comparing the flow characteristics of the fan of FIG. 1 with the fan of FIG. 3.

In combination with the impeller 102, the multi-sectioned inlet shroud 104 provides the cooling fan 100 with operating characteristics which were not attainable with the cooling fan 10. FIG. 4 is a graph comparing the operating characteristics of the cooling fan 100 with those of the cooling fan 10. This graph shows how the operating characteristics of the cooling fan 10 are altered when the impeller 16 and inlet shroud 64 are removed and replaced with the impeller 102 and inlet shroud 104. As shown in FIG. 4, the cooling fan 100 has a characteristic curve 118 which is shifted to the left with respect to the characteristic curve 72 of the fan 10. This results in the fan 100 having a stall line 120 which is also shifted to the left with respect to the stall line 76 of the fan 10. Consequently, the stall line 120 will occur at lower flow. As a result, the fan 100 is able to achieve similar pressure rises at lower flows than the fan 10.

In accordance with one aspect of the present invention, a number of different cooling fans comprising a variety of operating characteristics can be constructed using a single fan subassembly. Referring again to FIG. 1, for example, it may be seen that the cooling fan 10 includes a subassembly which is comprised of the motor 14, the outlet guide vane assembly 18 and the optional diffuser section 20. The fan 10 may therefore be assembled by connecting the impeller 16 to the rotor shaft 32 and the inlet shroud 64 to the outer ring 60 of the outlet guide vane assembly 18. In a similar fashion, the cooling fan 100 may be assembled by connecting the impeller 102 to the rotor shaft 32 and the inlet shroud 104 to the outer ring 60. Any number of other fans comprising distinct operating characteristics can be similarly constructed by connecting the appropriate impellers and inlet shrouds to the subassembly of the motor 14, the outlet guide vane assembly 18 and the optional diffuser section 20.

Figure 5:
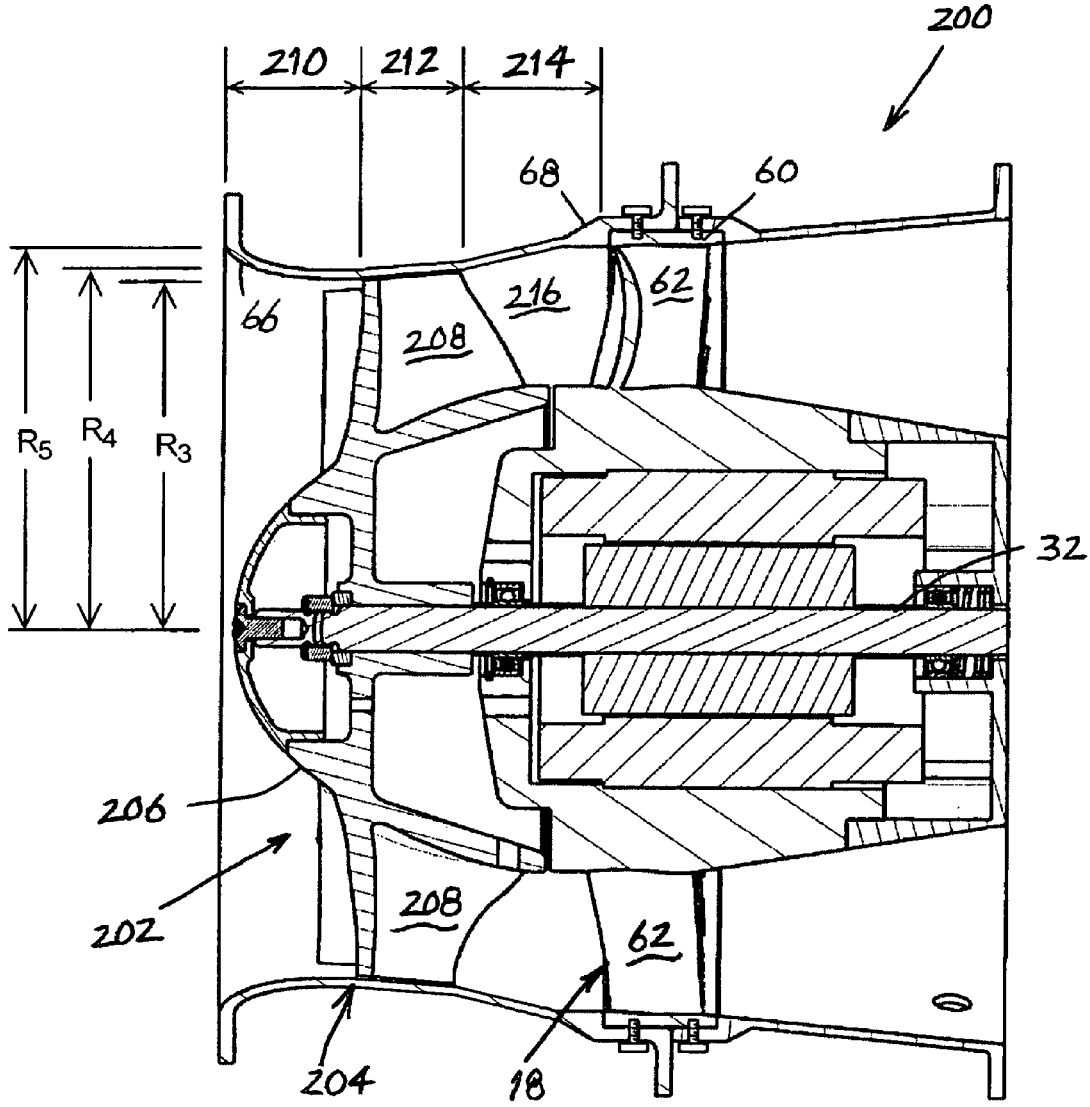
FIG. 5 is a cross-sectional view of an exemplary vane axial cooling fan in accordance with another embodiment of the present invention.

Referring to FIG. 5, for example, another embodiment of a cooling fan which embodies the principles of the present invention is shown. The cooling fan of this embodiment, generally 200, comprises an impeller 202 which is connected to the rotor shaft 32 and an inlet shroud 204 which is connected to the outer ring 60 of the outlet guide vane assembly 18 of the fan subassembly discussed above. The impeller 202 comprises an impeller hub 206 and a number of impeller blades 208 which extend radially from the impeller hub. In this embodiment, the diameter of the impeller blades 208 increases, preferably linearly in this embodiment, from the leading edge of the blades to the trailing edge of the blades. Accordingly, the impeller tip comprises a generally conical configuration. However, in this embodiment the average diameter of the impeller blades 208 is ideally still less than the average diameter of the impeller blades 40. The average diameter of the impeller blades may be determined by adding the diameters of the impeller blades at a number of different axial positions between the leading and trailing edges and then dividing this result by the number of positions.

As with the cooling fan 100 discussed above, the inlet shroud 204 of the cooling fan 200 comprises a number of axial sections: a first section 210 which extends from approximately the upstream end portion 66 of the inlet shroud to approximately the leading edge of the impeller 202, a second section 212 which extends from the first section to approximately the trailing edge of the impeller, and a third section 214 which extends from the second section to approximately the downstream end portion 62 of the inlet shroud. While, the first section 210 comprise a generally constant radius $R_3$, the radius of the second section 212 ideally varies to conform to the impeller tip, that is, it increases from the radius $R_3$ at the upstream end of the second section to a radius $R_4$ at the downstream end of the section. Thus, the second section 212 comprises a generally conical configuration which conforms to conical impeller tip.

Also, the radius of the third section 214 increases from the radius $R_4$ at the upstream end of the third section to a radius $R_5$ at the downstream end of the section. The third section 214 therefore defines an intermediate diffuser section 216 between the impeller blades 208 and the guide vanes 56 within which the air stream is allowed to expand. As with the diffuser section 116, the area ratio of the diffuser section 216 is about 1.2 or greater.

Thus, it may be seen that a variety of impeller and inlet shroud combinations may be used to construct a cooling fan with desired operating characteristics. Also, although the inlet shroud ideally includes an axial section which conforms to the shape of the impeller tip, the inlet shroud may comprise other axial sections which are configured to achieve a desired affect for a given application. As will be appreciated by those of skill in the art, the operating characteristics of a fan having a specific impeller and inlet shroud configuration may be determined using numerical analysis. Thus, depending on the desired operating characteristics for a particular application, a suitable impeller and inlet shroud may designed.

As an alternative to the impeller and inlet shroud pairs described above, for example, a cooling fan in accordance with the present invention may comprise an impeller whose tip is curved. In this embodiment, the diameter of the impeller blades increases non-linearly from the leading edge of the blades to the trailing edge of the blades. In addition, the inlet shroud may have an axial section adjacent the blades whose radius varies non-linearly from the upstream end of the section to the downstream end of the section in order to conform to the impeller tip.

In accordance with another feature of the present invention, a cooling fan having desired operating characteristics may be constructed from an existing cooling fan having a compatible subassembly. This may be achieved, for example, by removing the impeller and inlet shroud of the existing cooling fan and replacing them with an impeller and inlet shroud which have been determined, using numerical analysis, for example, to possess the configuration required to provide the fan with the desired operating characteristics. In this manner, an inventory of existing fans having operating characteristics which are no longer desirable can be retrofitted with new impellers and inlet shrouds to make them usable.

A cooling fan having desired operating characteristics may also be constructed by assembling the appropriate impeller and inlet shroud with an available fan subassembly. In this manner, a fan manufacturer may inventory a large quantity of fan subassemblies and then assemble them with the appropriate impellers and inlet shrouds in order to produce a variety of fans having distinct operating characteristics. This will greatly reduce the cost and complexity of the manufacturing process.

It should be recognized that, while the present invention has been described in relation to the preferred embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A vane-axial fan which comprises:

a fan housing which includes a fan inlet;

a motor which is connected to the fan housing;

an impeller which is removably connected to the motor, the impeller comprising an impeller hub, a number of impeller blades which extend radially outwardly from the impeller hub, an impeller leading edge, an impeller trailing edge and an impeller tip;

the fan housing including an inlet shroud which is positioned over the impeller, the inlet shroud including an upstream end portion within which the fan inlet is formed and a downstream end portion which is removably connected to a separate portion of the fan housing;

the inlet shroud further including a first section which extends axially from the upstream end portion to approximately the impeller leading edge, a second section which extends axially from the first section to approximately the impeller trailing edge, and a third section which extends axially from the second section to approximately the downstream end portion;

wherein the second section comprises a configuration which conforms to the configuration of the impeller tip;

wherein the third section comprises a radius which increases from approximately the upstream end of the third section to approximately the downstream end of the third section;

wherein the second section comprises a radius which increases from approximately the upstream end of the second section to approximately the downstream end of the second section; and wherein the radius of the second section increases linearly from approximately the upstream end of the second section to approximately the downstream end of the second section.

2. The fan of claim 1, wherein the second section comprises a radius which is generally constant from approximately the upstream end of the second section to approximately the downstream end of the second section.

3. The fan of claim 1, wherein the downstream end portion of the inlet shroud is removably connected to an outlet guide vane assembly which is connected to the motor.

4. The fan of claim 3, wherein the third section defines an intermediate diffuser section between the impeller and the outlet guide vane assembly.

5. The fan of claim 4, wherein the intermediate diffuser section comprises an area ratio of about 1.2 or greater.

6. A vane-axial fan which comprises:

a fan housing which includes a fan inlet;

a motor which is connected to the fan housing;

an impeller which is removably connected to the motor, the impeller comprising an impeller hub, a number of impeller blades which extend radially outwardly from the impeller hub, an impeller leading edge, an impeller trailing edge and an impeller tip;

the fan housing including an inlet shroud which is positioned over the impeller, the inlet shroud including an upstream end portion within which the fan inlet is formed and a downstream end portion which is removably connected to a separate portion of the fan housing;

the inlet shroud further including a first section which extends axially from the fan inlet to approximately the impeller leading edge, a second section which extends axially from the first section to approximately the impeller trailing edge, and a third section which extends axially from the second section to approximately the downstream end portion;

wherein the impeller blades comprise a diameter which increases continuously from the impeller leading edge to the impeller trailing edge;

wherein the second section comprises a configuration which conforms to the configuration of the impeller tip; and wherein the diameter of the impeller blades increases linearly from the impeller leading edge to the impeller trailing edge.

7. The fan of claim 6, wherein the diameter of the impeller blades increases non-linearly from the impeller leading edge to the impeller trailing edge.

8. The fan of claim 6, wherein the third section comprises a radius which increases from approximately the upstream end of the third section to approximately the downstream end of the third section.

9. The fan of claim 8, wherein the third section defines an intermediate diffuser section immediately downstream of the impeller blades.

10. The fan of claim 9, wherein the intermediate diffuser section comprises an area ratio of about 1.2 or greater.

11. The fan of claim 6, wherein the downstream end portion of the inlet shroud is removably connected to an outlet guide vane assembly which is connected to the motor.

* * * * *